US005244127A

United States Patent [19]

Hubbard

[11] Patent Number: 5,244,127

[45] Date of Patent: Sep. 14, 1993

[54] KEG TAP

[75] Inventor: J. Digby Hubbard, Monaco, Monaco

[73] Assignee: R.T.C. Limited, Dublin, Ireland

[21] Appl. No.: 928,608

[22] Filed: Aug. 13, 1992

[30] Foreign Application Priority Data

Aug. 22, 1991 [DE] Fed. Rep. of Germany ... 9110371[U]

[51] Int. Cl.[5] ..... B65D 83/00

[52] U.S. Cl. ..... 222/400.7; 222/394; 137/212

[58] Field of Search ..... 222/399, 400.5, 400.7, 222/400.8, 401, 394; 137/212

[56] References Cited

U.S. PATENT DOCUMENTS

| | | | |
|---|---|---|---|
| 4,125,209 | 11/1978 | Bailey | 222/400.7 |
| 4,159,102 | 6/1979 | Fallon et al. | 222/400.7 |
| 4,291,821 | 9/1981 | Nezworski | 222/400.7 |
| 4,516,698 | 5/1985 | Cerrato | 222/341 |
| 4,538,746 | 9/1985 | Hines | 222/400.7 |
| 4,612,952 | 9/1986 | Fallon | 137/212 |
| 4,711,377 | 12/1987 | Brown | 222/401 |
| 4,860,931 | 8/1989 | Hubbard | 222/400.8 |
| 5,176,298 | 1/1993 | Mogler et al. | 222/400.7 |

*Primary Examiner*—Andres Kashnikow
*Assistant Examiner*—Lesley D. Morris
*Attorney, Agent, or Firm*—Foley & Lardner

[57] ABSTRACT

A keg tap for dispensing a pressurized liquid from a container having a keg closure includes a substantially cylindrical housing which defines a pressure chamber within the housing. An axially movable valve-opening rod is inserted through the housing and pressure chamber and has one end which engages the keg closure. The rod has a continuous liquid passage extending from end to end and connecting at right angles with a liquid canal. A bracket supports the liquid canal and engages the rod so that the bracket and the rod are jointly raised and lowered. The rod extends through an insert in a lower end of the housing, the insert having bores arranged therein for receiving pins on a fork connected to a movable lever. The rod includes upper and lower flanges which define a groove therebetween for engaging another set of pins on the fork. The rod is upwardly and downwardly movable by moving the lever.

5 Claims, 2 Drawing Sheets

KEG TAP

BACKGROUND OF THE INVENTION

The present invention is related in general to a keg tap for dispensing a liquid, and in particular to a keg tap for dispensing a liquid under pressure from a container provided with a keg closure. The keg tap of the present invention includes a housing connected with a pressure-producing element and surrounding a pressure chamber, and an axially movable valve-opening rod inserted through the pressure chamber for engagement with a keg closure. The end of the axially movable valve-opening rod projecting beyond the housing wall includes a valve-opening element and the other end of the rod is connected to an operating part.

In gastronomy, keg taps are used for tapping beer from barrels. Tap heads are known for basket fittings as well as for flat fittings. Both embodiments include a housing encompassing a pressure chamber through which is inserted a lever-operated valve-opening rod for opening the valve of the keg closure. The tap head has a pressure gas connection and a connection for a pipe leading to a tapcock. Keg taps of this kind are not suitable for domestic use.

Furthermore, U.S. Pat. No. 4,516,698 discloses a keg tap for dispensing a drink maintained under pressure from a container provided with a keg closure. The '698 keg tap has a housing connected to a pressure-producing element and an axially-movable valve-opening rod that engages with a keg closure. One end of the rod includes a valve-opening element and the other end is connected to an operating part. However, a disadvantage of this prior art is that, before attachment of the tap, the keg closure of the container must first be opened manually.

U.S. Pat. No. 4,860,931, issued in the name of the inventor of the present invention, is hereby incorporated by reference. The '931 patent suggests tapping a keg by lowering a valve-opening rod by rotating a threaded ring. The rotary movement of the threaded ring lowers not only a bracket with a liquid canal provided therein but also the valve-opening rod connected thereto.

The rotary movement of the threaded ring needs to be improved, because the screwing movement requires several hand grips. This is an impediment, for example, in the case of rapid keg changes. Also, control of the complete tapping of the keg is difficult. Another problem is that turning of the threaded ring up to the stop overstresses the thread parts, which are made of synthetic material. In any newly designed keg tap, the one-piece construction of the housing should be maintained.

SUMMARY OF THE INVENTION

Therefore, it is an object of the present invention to provide a keg tap having a housing of one-piece construction, wherein the upwards and downwards movement of the valve-opening rod is facilitated by a lever mechanism.

This object and other objects and advantages of the present invention are attained by a keg tap for dispensing a pressurized liquid from a container having a keg closure, the keg tap including a substantially cylindrical housing which defines a pressure chamber within said housing; an axially movable valve-opening rod inserted through said housing and pressure chamber and having first and second ends, wherein said first end projects beyond said housing and engages said keg closure; a valve-opening element formed on said first end; said rod having formed therein a continuous liquid passage extending from an externally open end at said valve-opening element to said second end; a liquid canal at a right angle to and fluidly communicable with said continuous liquid passage at said second end; a bracket for supporting said liquid canal, wherein said bracket is inserted through a recess in a wall of said housing and wherein said bracket engages said rod so that said bracket and said rod are jointly raised and lowered; an outlet on said bracket and fluidly communicable with said liquid canal; a closure valve on said bracket for opening and closing said outlet; an insert in a lower end of said housing, said rod extending through said insert and said insert having bores arranged therein; a movable lever having a fork, said fork having first and second pins formed thereon, said first pins for insertion into said bores; upper and lower flanges formed on said rod adjacent said bores and defining a groove therebetween, said second pins engaging said groove whereby said rod is upwardly and downwardly movable by moving said lever; a sleeve fixed on and partly encompassing said lower end of said housing, wherein said housing, said insert, and said sleeve each have slots formed therein for guiding said fork of said lever; and holding elements formed on said sleeve for securing said keg tap on said keg closure.

BRIEF DESCRIPTION OF THE DRAWINGS

The present invention will now be explained in more detail with reference to the accompanying drawings, in which.

DETAILED DESCRIPTION OF THE PREFERRED EMBODIMENTS

Figure 1:
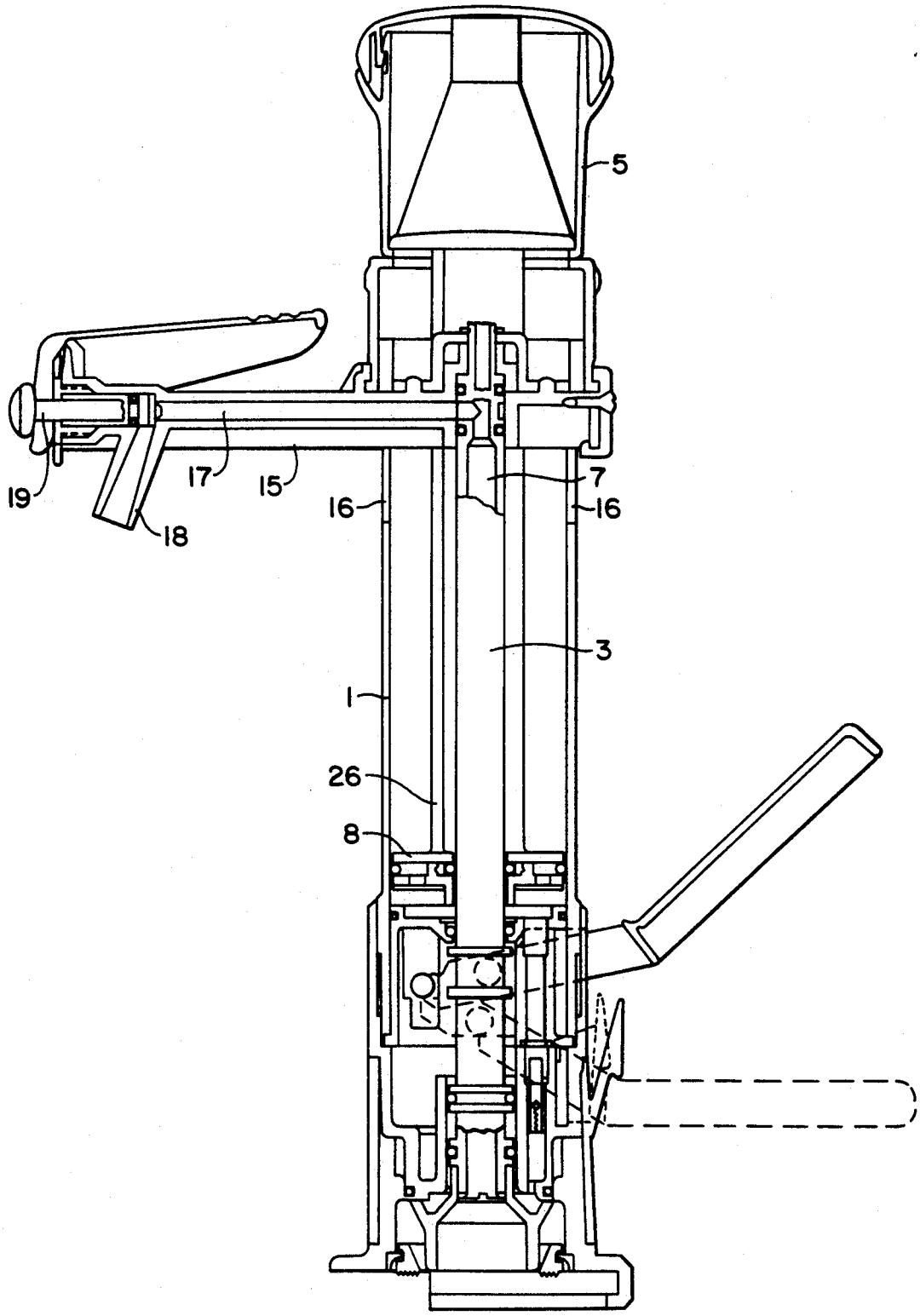
FIG. 1 shows a cutaway view of the tap.

According to the present invention, there is provided a keg tap for dispensing a liquid maintained under pressure from a container provided with a keg closure. The keg tap includes a housing that surrounds a pressure chamber through which is inserted an axially movable valve-opening rod that cooperates with the keg closure. One end of the valve-opening rod projects beyond the housing wall and includes a valve-opening element and is connected with an operating element. The housing is substantially cylindrical, and the valve-opening rod which passes through the housing has a continuous liquid passage in the valve-opening element opening outwardly which, on the end opposite the valve-opening element, passes over into a liquid canal. The liquid canal is arranged substantially at right-angles to the liquid passage and is cut out of a bracket inserted through a recess in the wall of the housing and has an outlet for the liquid closable with a closure valve. The bracket and the valve-opening rod are jointly raised and lowered. In the lower end of the housing, the valve-opening rod passes through an insert having bores into which are inserted pins of a fixable lever provided with a fork, whereby, adjacent to the bores on the insert, the valve-opening rod has formed thereon an upper and a lower flange between which another pair of opposite-lying pins formed on the fork are engaged and whereby the valve-opening rod is upwardly and downwardly movable with the help of the lever. On the lower end of the housing a sleeve is pushed on and fixed. The sleeve partly encompasses the housing. The housing, insert, and sleeve have slots lying laterally next to the valve-opening rod, in which the fork of the lever is guided. Holding elements for securing the tap on the keg are formed on the sleeve.

The valve-opening rod is guided through an insert that is provided fixedly below in the housing. The insert forms a mounting for the ends of a lever ending in a fork. The housing has slots through which the fork can be inserted from outside into the slots of the insert lying therebehind and in which, for assembling, the pins on the fork ends snap into the bores of the insert due to the spring action of the fork, which is made from a synthetic material. At about the height of the mounting bores of the insert, the valve-opening rod has upper and lower flanges between which are engaged pins. The pins are arranged on both inner sides of the fork, via which the valve-opening rod is raised and lowered according to the lever movement. In this way, the lever is also secured against pulling out.

A sleeve is pushed onto the housing from below and connected to the housing. The sleeve has slots and the necessary holding element for the connection with the keg, for example, a thread.

The insert advantageously carries a non-return valve between the slots so that the fork encloses not only the valve-opening rod but also the seat of the non-return valve. The mantle of the part of the housing lying thereabove serves in a known manner as the cylinder of an air pump. The sleeve is provided with a connection for the introduction of compressed air into the keg via the non-return valve.

The lever must be secured in its lower position. For this purpose, a ring of synthetic material is pushed over the lower end of the sleeve. The ring carries a locking bar and can be interlocked with the lever which has an edge formed thereon. In particular, the spring action of the locking bar can be utilized in such a way that, when pressing down the lever, it snaps automatically over the edge of the lever. For moving the lever upwards, the locking bar only needs to be pushed back slightly against its spring action in order to free the lever.

The sleeve, because of the non-return valve that passes through it, cannot be screw-connected with the housing but, on the other hand, must have a secure, one-piece connection with the housing. Therefore, the sleeve is snapped onto the housing and can optionally be secured against turning by means of a screw. The connection between the sleeve and the housing consists of several grooves and opposite-lying, inter-engaging, corresponding key seatings.

The cross-sectional enlargement necessary for the drawing-up of the sleeve on to the keying is, according to the present invention, possible in an elegant manner in that the slots in the housing through which the fork is inserted are downwardly open so that those of the sleeve can be closed above and below in order to ensure the necessary very secure connection.

Referring to FIG. 1, the tap comprises a housing 1 of substantially round cross-section, and, arranged in the housing, an air pump with pump valve 8 and pump rod 26 operable via a grip 5. The housing has opposite-lying recesses 16 for vertical movement of a bracket 15 with closure valve 19 and outlet 18, which move together with a valve-opening rod 3. The bracket 15 is securely connected to the valve-opening rod 3 in which lies a liquid passage 7 and which is attached to a liquid canal of the bracket 15.

Figure 2:
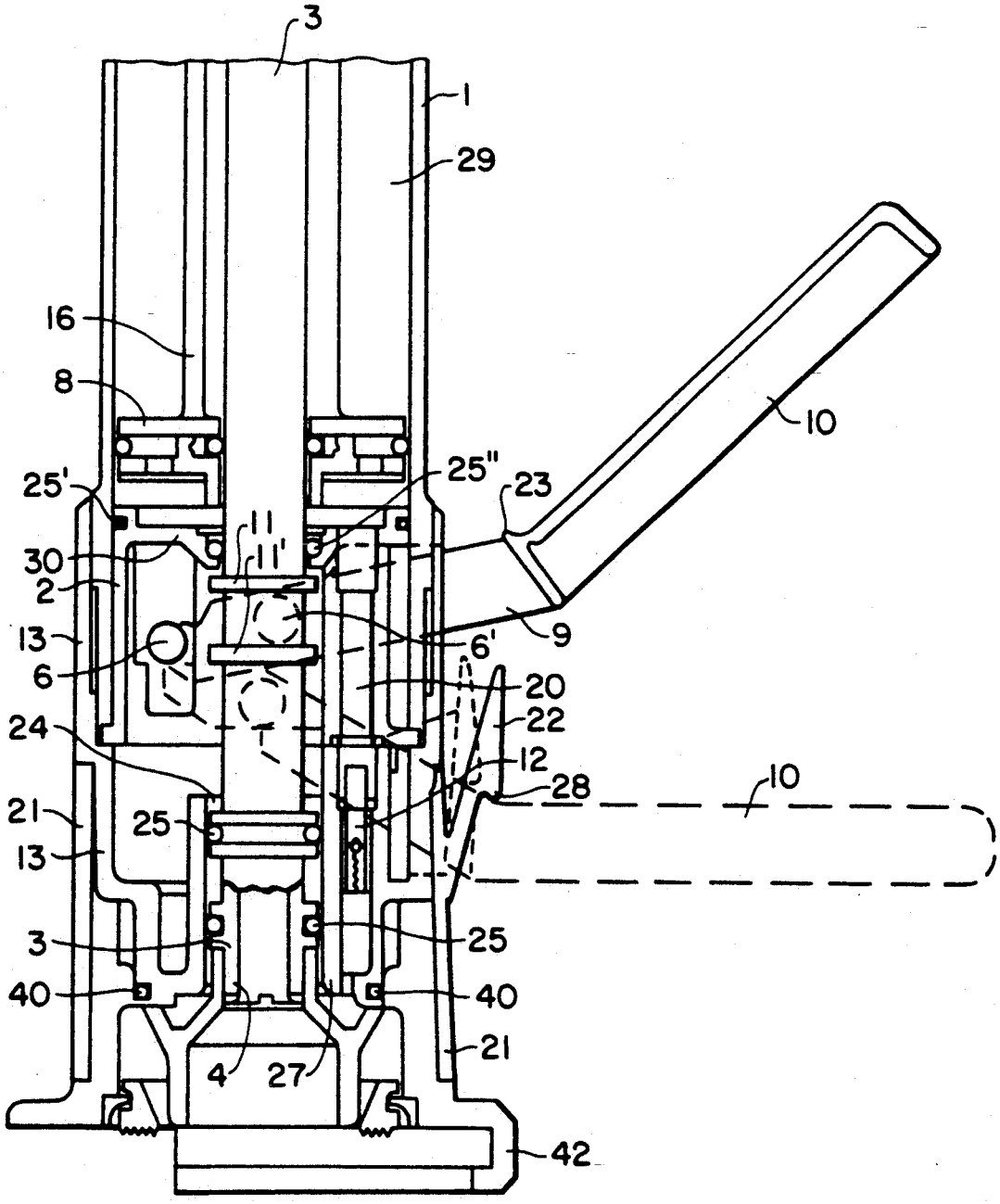
FIG. 2 shows an enlarged view of the lower portion of FIG 1.

Referring to FIG. 2, in the lower end of the housing 1 is an insert 2, which has bores (not shown) arranged in bridges. The bores engage inner-lying, terminally arranged pins 6 on a fork 9 and thus provide a fixed tilt mounting for a lever 10. The fork 9 engages axially running slots arranged towards the lever via which the lever can be mounted.

Near the securely mounted pins 6, the valve-opening rod 3 has formed thereon upper and lower flanges 11 and 11'. Between the upper and lower flanges 11 and 11', the rod 3 is engaged by pins 6' formed on the fork 9. The pins 6' are opposite each other and located inwardly on the fork 9. The force for raising and lowering the valve-opening rod 3 is transmitted via the pins 6' to the flange or the rod which below carries the valve-opening element for the keg.

Against the pump chamber 29, the insert 2 is sealed off via an outer-lying O-ring 25' and a plate 30 encircling the valve-opening rod, as well as inner O-ring 25''. The non-return valve 12 connected with the pump engages in a seat 20 of the insert 2, the seat 20 being arranged between the fork limbs. The non-return valve 12 projects into a bushing 27 and is there held sealingly and connectable via its lower opening with the keg valve.

This bushing 27 is part of a sleeve 13, which can be snapped on to the housing 1, and which, on the lower free end thereof, carries fixing means or holding elements 40 (single pitch coarse thread) for mounting the tap on the keg closure 42. For this purpose, the sleeve has a central, integrally formed, co-axial bushing 24 in which the lower end of the valve-opening rod is sealed off against pressure loss from the keg with the help of two O-rings 25.

The sleeve 13 is overlapped by a ring 21, also made of synthetic material, on which is formed the resilient locking bar 22 which engages between the fork arms 9 and, with its catch 28 over the edge 23 of the lever 10, secures the lever in the lower position, as is illustrated in the Figures by broken lines.

The whole housing is thus constructed in one piece from parts securely connected with one another and is able to take up the lever forces and to transmit them to the keg valve to be opened.

The lever mechanism lies inwardly and does not constitute a danger for injury.

Although the invention has been described in relation to certain preferred embodiments, numerous alterations and variations are possible without departing from the spirit and scope of the invention.

What is claimed is:

1. A keg tap for dispensing a pressurized liquid from a container having a keg closure, comprising:

a substantially cylindrical housing which defines a pressure chamber within said housing;

an axially movable valve-opening rod inserted through said housing and pressure chamber and having first and second ends, wherein said first end projects beyond said housing and engages said keg closure;

a valve-opening element formed on said first end;

said rod having therein a continuous liquid passage extending from an externally open end at said valve-opening element to said second end;

a liquid canal at a right angle to and fluidly communicable with said continuous liquid passage at said second end;

a bracket for supporting said liquid canal, wherein said bracket is inserted through a recess in a wall of said housing and wherein said bracket engages said rod so that said bracket and said rod are jointly raised and lowered;

an outlet fluidly communicable with said liquid canal;

a closure valve for opening and closing said outlet;

an insert in a lower end of said housing, said rod extending through said insert and said insert having bores arranged therein;

a movable lever having a fork, said fork having first and second pins formed thereon, said first pins for insertion into said bores;

upper and lower flanges formed on said rod adjacent said bores and defining a groove therebetween, said second pins engaging said groove whereby said rod is upwardly and downwardly movable by moving said lever;

a sleeve fixed on and partly encompassing said lower end of said housing, wherein said housing, said insert, and said sleeve each have slots formed therein for guiding said fork of said lever;

holding elements formed on said sleeve for securing said keg tap on said keg closure.

2. The keg tap of claim 1, further comprising a non-return valve connected to said pressure chamber; and a seat for said non-return valve, wherein said seat is disposed between said slots of said insert.

3. The keg tap of claim 1, further comprising a ring slidable onto said sleeve and having an elastic locking bar formed thereon, wherein said lever includes an edge such that said elastic locking bar engages said edge to lock said lever in a downward position.

4. The keg tap of claim 1, further comprising a bushing integrally formed with said sleeve; and O-rings, wherein said bushing and O-rings seal said rod at said second end.

5. The keg tap of claim 1, further comprising a multi-groove snap closure for fixing said sleeve on said lower end of said housing wherein said slots of said housing are downwardly open.

* * * * *